US008042309B2

(12) United States Patent
Wolf et al.

(10) Patent No.: US 8,042,309 B2
(45) Date of Patent: Oct. 25, 2011

(54) PANELIZED VENEER WITH BACKER-TO-BACKER LOCATORS

(75) Inventors: David H. Wolf, Newark, OH (US); Harold C Attebery, II, Granville, OH (US); Jeffrey E. Klotz, Newark, OH (US); James J. Dottavio, Granville, OH (US); David C Hines, Swanton, OH (US); Joy M. Stickel, Columbus, OH (US); Joshua Broehl, Worthington, OH (US); Jamison Float, Westerville, OH (US)

(73) Assignee: Boral Stone Products LLC, Roswell, GA (US)

( * ) Notice: Subject to any disclaimer, the term of this patent is extended or adjusted under 35 U.S.C. 154(b) by 555 days.

(21) Appl. No.: 11/933,216

(22) Filed: Oct. 31, 2007

(65) Prior Publication Data

US 2008/0155922 A1 Jul. 3, 2008

Related U.S. Application Data

(63) Continuation-in-part of application No. 11/647,751, filed on Dec. 29, 2006.

(51) Int. Cl.
*E04F 13/08* (2006.01)

(52) U.S. Cl. ..... 52/314; 52/315; 52/389; 52/539; 52/555

(58) Field of Classification Search ..... 52/555, 52/314, 315, 389, 539
See application file for complete search history.

(56) References Cited

U.S. PATENT DOCUMENTS

| | | | | | |
|---|---|---|---|---|---|
| 448,733 | A | * | 3/1891 | Sagendorph | 52/526 |
| 1,688,405 | A | * | 10/1928 | Stoehr | 52/506.01 |
| 1,976,947 | A | * | 10/1934 | Krauss | 52/596 |
| 2,030,556 | A | * | 2/1936 | Veltung | 52/318 |
| 2,198,466 | A | * | 4/1940 | Stolze | 52/385 |
| 2,209,283 | A | * | 7/1940 | Ronzone | 52/314 |
| 2,214,387 | A | * | 9/1940 | Snyder | 428/172 |
| 2,300,258 | A | * | 10/1942 | Kublanow | 52/774 |
| D135,475 | S | | 4/1943 | Wright | |
| D135,476 | S | | 4/1943 | Wright | |
| 2,592,244 | A | * | 4/1952 | Chamberlain | 52/515 |
| 2,991,592 | A | * | 7/1961 | Rauen | 52/527 |
| 3,004,369 | A | * | 10/1961 | Findlay | 52/408 |
| 3,131,514 | A | * | 5/1964 | Siek | 52/315 |
| 3,177,279 | A | | 4/1965 | Bilodeau | |

(Continued)

FOREIGN PATENT DOCUMENTS

EP 0 182 567 * 11/1985

(Continued)

OTHER PUBLICATIONS

International Search Report dated Apr. 21, 2008 in PCT/ US2007/ 025532.

*Primary Examiner* — Robert Canfield
(74) *Attorney, Agent, or Firm* — Alston and Bird, LLP

(57) ABSTRACT

A cast veneer wall panel includes a backing panel having a rear face and a front face. The front face includes a boundary wall and a continuous abutment extending around a perimeter of a casting field. The cast veneer wall panel further includes a facing panel formed from a cast material that is received and held within the casting field. The facing panel includes at least one design element.

24 Claims, 8 Drawing Sheets

U.S. PATENT DOCUMENTS

| | | | | | |
|---|---|---|---|---|---|
| 3,217,453 | A | * | 11/1965 | Medow | 52/314 |
| 3,232,017 | A | * | 2/1966 | Prusinski et al. | 52/309.9 |
| 3,248,834 | A | * | 5/1966 | Polis | 52/316 |
| 3,310,921 | A | * | 3/1967 | Forcadell | 52/391 |
| 3,332,187 | A | | 7/1967 | Arcari | |
| 3,335,048 | A | * | 8/1967 | Morain | 428/48 |
| 3,344,011 | A | * | 9/1967 | Goozner | 428/67 |
| 3,350,827 | A | | 11/1967 | Sugar | |
| 3,496,694 | A | * | 2/1970 | Hicks et al. | 52/746.12 |
| 3,521,418 | A | * | 7/1970 | Bartoloni | 52/318 |
| 3,524,790 | A | * | 8/1970 | Mason | 428/60 |
| 3,613,326 | A | * | 10/1971 | Mollman | 52/314 |
| 3,621,625 | A | * | 11/1971 | Medow | 52/314 |
| 3,646,715 | A | | 3/1972 | Pope | |
| 3,683,579 | A | * | 8/1972 | Beardsley | 52/389 |
| 3,701,228 | A | | 10/1972 | Taylor | |
| 3,740,910 | A | | 6/1973 | Taylor et al. | |
| 3,885,008 | A | * | 5/1975 | Martin | 264/45.3 |
| 3,908,326 | A | | 9/1975 | Francis | |
| 3,968,610 | A | | 7/1976 | Medow | |
| 4,011,702 | A | * | 3/1977 | Matyas | 52/387 |
| 4,026,083 | A | | 5/1977 | Hoyt et al. | |
| 4,034,528 | A | * | 7/1977 | Sanders et al. | 52/309.4 |
| 4,219,984 | A | | 9/1980 | de San | |
| 4,223,490 | A | * | 9/1980 | Medow | 52/98 |
| 4,271,111 | A | | 6/1981 | Sheber | |
| 4,299,069 | A | | 11/1981 | Neumann | |
| 4,407,104 | A | | 10/1983 | Francis | |
| 4,495,738 | A | | 1/1985 | Sheber | |
| 4,522,002 | A | * | 6/1985 | Davis et al. | 52/309.1 |
| 4,589,241 | A | * | 5/1986 | Volpenhein | 52/315 |
| 4,644,719 | A | | 2/1987 | Salazar | |
| 4,665,673 | A | | 5/1987 | Diana | |
| 4,858,410 | A | * | 8/1989 | Goldman | 52/591.5 |
| 4,932,182 | A | * | 6/1990 | Thomasson | 52/318 |
| 5,052,161 | A | | 10/1991 | Whitacre | |
| 5,072,562 | A | * | 12/1991 | Crick et al. | 52/533 |
| 5,076,037 | A | * | 12/1991 | Crick et al. | 52/520 |
| 5,228,937 | A | | 7/1993 | Passeno | |
| 5,232,646 | A | | 8/1993 | Nasvik et al. | |
| 5,311,714 | A | | 5/1994 | Passeno | |
| 5,347,784 | A | * | 9/1994 | Crick et al. | 52/520 |
| 5,537,792 | A | * | 7/1996 | Moliere | 52/531 |
| 5,787,666 | A | | 8/1998 | Sherry | |
| 5,836,572 | A | | 11/1998 | Sugiyama | |
| 5,956,914 | A | * | 9/1999 | Williamson | 52/520 |
| 6,151,854 | A | | 11/2000 | Gutjahr | |
| 6,237,294 | B1 | | 5/2001 | Rygiel | |
| 6,295,777 | B1 | * | 10/2001 | Hunter et al. | 52/519 |
| 6,336,303 | B1 | * | 1/2002 | Vandeman et al. | 52/520 |
| 6,355,193 | B1 | | 3/2002 | Stott | |
| 6,408,585 | B1 | | 6/2002 | Tajima | |
| 6,516,578 | B1 | | 2/2003 | Humsaker | |
| 6,634,617 | B2 | | 10/2003 | Potvin | |
| D497,013 | S | | 10/2004 | Hughes | |
| 6,802,165 | B1 | | 10/2004 | Passeno | |
| 6,808,667 | B2 | | 10/2004 | Nasvik | |
| 6,830,405 | B2 | | 12/2004 | Watanabe | |
| 6,857,248 | B2 | | 2/2005 | Ouellet et al. | |
| D510,146 | S | | 9/2005 | Attebery, II et al. | |
| 6,951,086 | B2 | | 10/2005 | Passeno | |
| 6,955,019 | B2 | * | 10/2005 | Donlin et al. | 52/520 |
| 6,973,756 | B2 | | 12/2005 | Hatzinikolas | |
| 6,990,778 | B2 | | 1/2006 | Passeno | |
| RE39,091 | E | | 5/2006 | Kuelker | |
| 7,240,461 | B1 | * | 7/2007 | Vandeman et al. | 52/539 |
| 7,587,871 | B2 | * | 9/2009 | Perry | 52/539 |
| 7,617,647 | B2 | * | 11/2009 | Turner et al. | 52/385 |
| 7,735,287 | B2 | * | 6/2010 | Gaudreau | 52/526 |
| 2003/0066259 | A1 | | 4/2003 | Sudweeks | |
| 2003/0154676 | A1 | | 8/2003 | Schwartz | |
| 2005/0102946 | A1 | * | 5/2005 | Stucky et al. | 52/518 |
| 2005/0188642 | A1 | | 9/2005 | Correia | |
| 2005/0210811 | A1 | | 9/2005 | Nasvik | |
| 2005/0229500 | A1 | | 10/2005 | Howard | |
| 2005/0257475 | A1 | | 11/2005 | Gong et al. | |
| 2006/0260223 | A1 | * | 11/2006 | Wang | 52/177 |
| 2007/0022687 | A1 | | 2/2007 | Correia | |
| 2007/0044402 | A1 | | 3/2007 | Hess | |
| 2007/0137128 | A1 | | 6/2007 | Viau et al. | |
| 2008/0155921 | A1 | * | 7/2008 | Wolf et al. | 52/386 |
| 2009/0193742 | A1 | * | 8/2009 | Wolf et al. | 52/311.1 |
| 2009/0249719 | A1 | * | 10/2009 | Broehl et al. | 52/250 |

FOREIGN PATENT DOCUMENTS

| | | | | |
|---|---|---|---|---|
| FR | 2461073 | | * | 1/1981 |
| FR | 2 768 452 | A1 | * | 9/1997 |
| GB | 444503 | | | 3/1936 |
| WO | WO 2006/042883 | | | 4/2006 |

* cited by examiner

PANELIZED VENEER WITH BACKER-TO-BACKER LOCATORS

This application is a continuation-in-part of prior U.S. patent application Ser. No. 11/647,751 filed on Dec. 29, 2006.

TECHNICAL FIELD AND INDUSTRIAL APPLICABILITY OF THE INVENTION

This invention relates generally to the construction field and, more particularly, to a cast veneer wall panel, a backing panel for a cast veneer wall panel and a method of making a cast veneer wall panel.

BACKGROUND OF THE INVENTION

Cast veneer wall panels have been developed as a quick and efficient way to provide a masonry appearance for a building while simplifying construction and lowering construction costs. Such panels typically include a front plate or panel carrying a series of design or masonry elements. These design elements simulate brick, stone, tile and other masonry building components or materials commonly used in the construction of buildings. Examples of cast veneer wall panels are disclosed in U.S. Pat. No. 3,332,187 to Arcari and co-pending U.S. patent application Ser. No. 11/647,679, entitled "Fiber Reinforced Concrete Stone Panel System" owned by the assignee of the present invention and incorporated herein by reference.

Cast veneer wall panels are typically made from reinforced construction materials such as fiberglass reinforced concrete. While cast veneer wall panels made from such reinforced materials are more resistant to damage from handling during packaging, shipping and installation, further improvements in durability to reduce loss due to breakage are still desired. The present invention relates to a cast veneer wall panel of enhanced durability providing significantly improved handling characteristics due to light weight construction and ability to fasten by nailing. The cast veneer wall panel is also easier and quicker to orient, seat and install.

SUMMARY OF THE INVENTION

In accordance with the purposes of the present invention as described herein, an improved cast veneer wall panel is provided. The cast veneer wall panel comprises a backing panel including a rear face and a front face. The front face includes a casting field at least partially encircled by a boundary wall. In addition, the cast veneer panel includes a facing panel formed from a cast material that is received and held within the casting field on the backing panel. The facing panel includes at least one design element such as a simulated stone, brick or tile. Typically the facing panel includes multiple design elements at spaced locations.

The backing panel preferably further includes a continuous, or substantially continuous, abutment extending around a perimeter of the casting field. Further, the backing panel includes a mounting flange that extends beyond a first portion of the continuous abutment. In addition, at least one locating slot is provided in the first portion of the continuous abutment. That locating slot may extend into the mounting flange.

Further, the cast veneer panel includes at least one locating tab projecting from a second portion of the continuous abutment. The first and second portions of the continuous abutment are provided opposite one another on the backing panel. Accordingly, the at least one locating tab on one cast veneer wall panel may be received in and held in the at least one locating slot of another, adjacent cast veneer wall panel and thereby properly align multiple panels during installation. The rear face of the backing panel preferably includes a concavity and that concavity nests in the at least one design element. Further, the at least one locating slot may extend into the concavity. The backing panel also includes apertures in the concavity. Casting material forming the facing panel extends through the apertures into the concavity to key the backing panel and the facing panel together.

In accordance with an additional aspect of the present invention the rear face of the backing panel includes a series of dimples that project outwardly from the rear face. In one possible embodiment a row of dimples are provided along the mounting flange. The row of dimples provides a minimum flow area of about 65%.

In accordance with still another aspect of the present invention a cast veneer wall panel comprises a backing panel including (a) a rear face, (b) a front face including a casting field, (c) at least one locating slot along a first edge and (d) at least one locating tab, which may form a hook, along a second edge. The cast veneer wall panel also includes a facing panel formed from a cast material received and held on the casting field. The facing panel includes at least one design element.

The wall panel further includes a mounting flange that extends beyond the first edge. In one possible embodiment the at least one locating slot extends into the mounting flange. Further, the rear face of the backing panel includes a concavity and the concavity nests in the at least one design element. The at least one locating slot may extend into this concavity.

Still further, the backing panel includes apertures in the concavity. Casting material forming the facing panel extends through the apertures into the concavity to key the backing panel and the facing panel together.

In accordance with yet another aspect of the present invention a backing panel is provided for a cast veneer wall panel. The backing panel comprises a body including a rear face and a front face. The front face includes a casting field at least partially encircled by a boundary wall. The backing panel preferably further includes a continuous abutment extending around a perimeter of the casting field. In addition, the backing panel has a first mounting flange extending beyond a first portion of the continuous abutment. At least one locating slot is provided in the first portion of the continuous abutment. The at least one locating slot may also extend into the first mounting flange.

The backing panel further includes at least one locating tab projecting from a second portion of the continuous abutment. The first and second portions of the continuous abutment are provided opposite one another on the backing panel.

Still further, the backing panel includes a series of dimples projecting outwardly from the rear face. A row of dimples may be provided along the mounting flange. The row of dimples may provide a minimum flow area of about 65%. In addition the backing panel includes a second mounting flange extending beyond a third portion of the continuous abutment provided between the first and second portions.

In accordance with yet another aspect of the present invention a backing panel for a cast veneer wall panel comprises a body including (a) a rear face, (b) a front face including a casting field, (c) at least one locating slot along a first edge and (d) at least one locating tab along a second edge. A first mounting flange extends beyond the first edge. The at least one locating slot extends into the first mounting flange. In addition the rear face of the backing panel includes a concavity and the at least one locating slot may extend into that concavity.

In the following description there is shown and described several different embodiments of the invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated herein and forming a part of the specification, illustrate several aspects of the present invention and together with the description serve to explain certain principles of the invention. In the drawings.

Reference will now be made in detail to the present preferred embodiments of the invention, examples of which are illustrated in the accompanying drawings.

DETAILED DESCRIPTION OF THE PREFERRED EMBODIMENTS OF THE INVENTION

Figure 1:
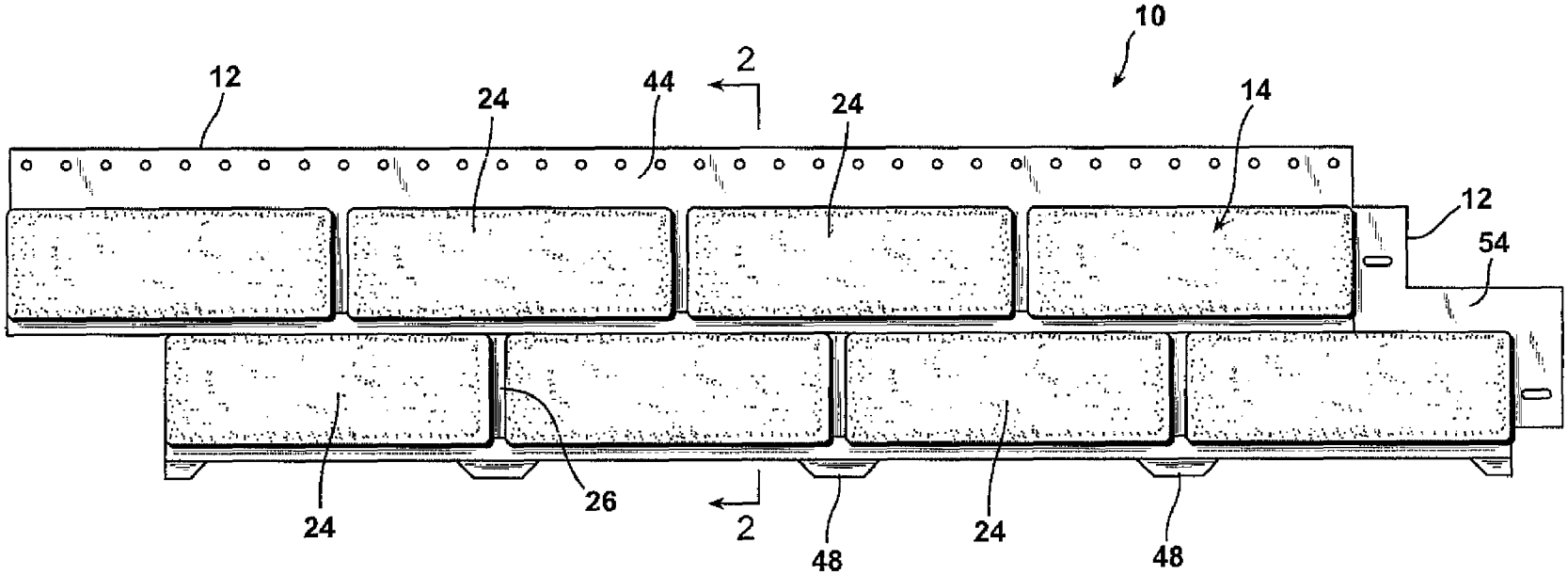
FIG. 1 is a perspective view of the cast veneer wall panel of the present invention.
Figure 2:
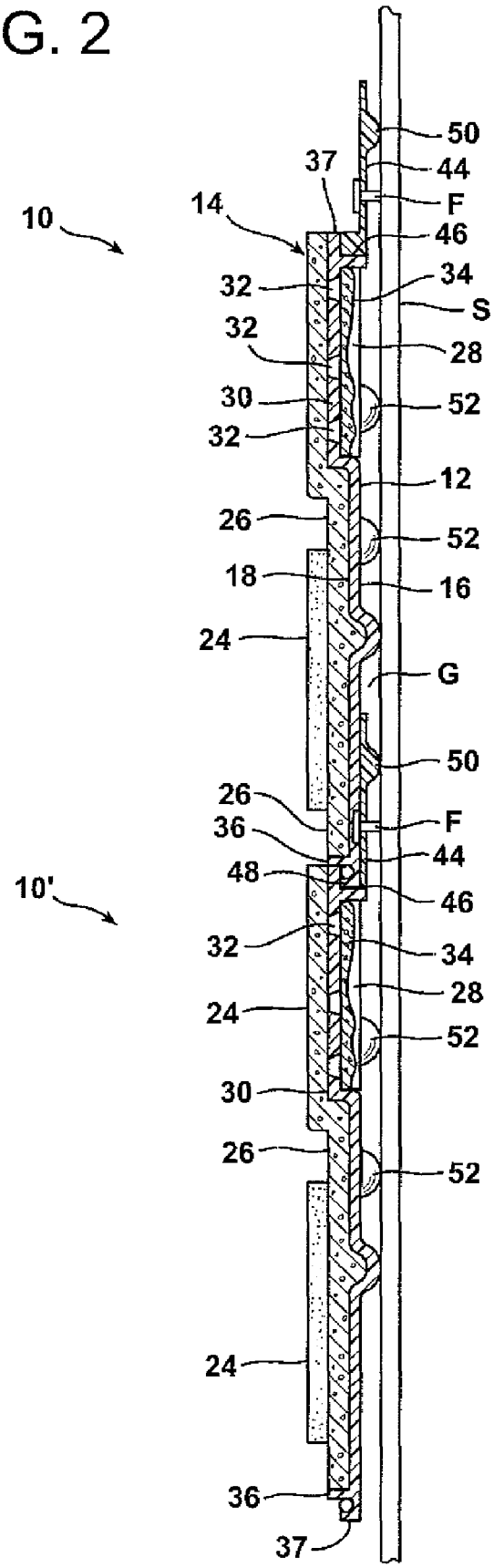
FIG. 2 is a schematical cross sectional view of two cast veneer wall panels of the type illustrated in FIG. 1 illustrating how they are mounted to the sheeting of a building.

Reference is now made to FIGS. 1-2 illustrating the cast veneer wall panel 10 of the present invention. As illustrated, the cast veneer wall panel 10 comprises a backing panel 12 and a facing panel 14. The body of the backing panel 12 includes a rear face 16 and a front face 18. As further illustrated in FIG. 3, the front face 18 includes a boundary wall 20 that at least partially encircles a casting field 22. More specifically, the wall 20 comprises a raised lip or ridge.

The backing panel 12 may be made from any suitable material such as wood, treated wood, metal, such as galvanized steel, aluminum, copper or as a single molded piece from a polymer material or a composite material. Polymer materials useful for making the backing panel 12 include various thermoplastic and thermoset resins, including but not limited to polyolefins, polyesters, polyvinyl chloride, polypropylene, polyethylene, polyamide, epoxy, vinyl ester, acrylic, polystyrene, ABS, melamine and mixtures thereof. Composite materials used to make the backing panel 20 include reinforcing material and a matrix binder. Appropriate reinforcing materials useful in the present invention include but are not limited to glass fibers, natural fibers, mineral fibers, basalt fibers, carbon fibers, kanaf fibers, jutte fibers, hemp fibers, E-glass fibers, C-glass fibers, R-glass fibers, S-glass fibers, ECR-glass fibers, AR-glass fibers and mixtures thereof. It should be appreciated that substantially any type of glass fiber may be used for reinforcement fibers. Glass fibers appropriate for use in the present invention may be loose chopped strand or glass mat and include those available from Owens Corning with headquarters in Toledo, Ohio, under the trademarks Hypertex and Advantex. Matrix binder materials useful for this purpose include but are not limited to polyolefins, polyesters, polyvinyl chloride, polypropylene, polyethylene, polyamide, epoxy, vinyl ester and mixtures thereof.

The facing panel 14 is formed from a cast material received and preferably held within the casting field 22 by the upstanding, encircling boundary wall 20. The facing panel 14 includes at least one design element 24. In the illustrated embodiment the cast veneer wall panel 10 includes a series of a masonry or design elements 24. The design elements 24 are illustrated as simulated bricks aligned in a regimented pattern in accordance with standard masonry practices. In other embodiments, the design elements 24 comprise stones, such as ledgestones, limestone, or substantially any other stone texture available for example from Owens Corning of Toledo, Ohio under the Cultured Stone® brand. The facing panel 14 also includes a mortar bed area 26 between the design elements 24. Following installation the mortar bed area 26 is typically grouted by injecting mortar between the design elements 24 so as to provide a finished masonry appearance. In an alternative embodiment, certain textures may resemble a dry stack, and not include the mortar.

While the design elements 24 illustrated in the drawing figures correspond to simulated bricks, it should be appreciated that substantially any other masonry material known in the art may be simulated including bricks of different sizes, stones of different shapes and sizes, tiles of different shapes and sizes and the like. The facing panel 14 is made from a cast material such as concrete, reinforced concrete, reinforced cementitious material and mixtures thereof. Typically the cast material reinforcement comprises fibers selected from a group of materials consisting of glass fibers, mineral fibers, natural fibers, polymer fibers and mixtures thereof. Where glass fibers are used they are typically of the E-glass or AR-glass type, which exhibit some alkali resistance.

Figure 4:
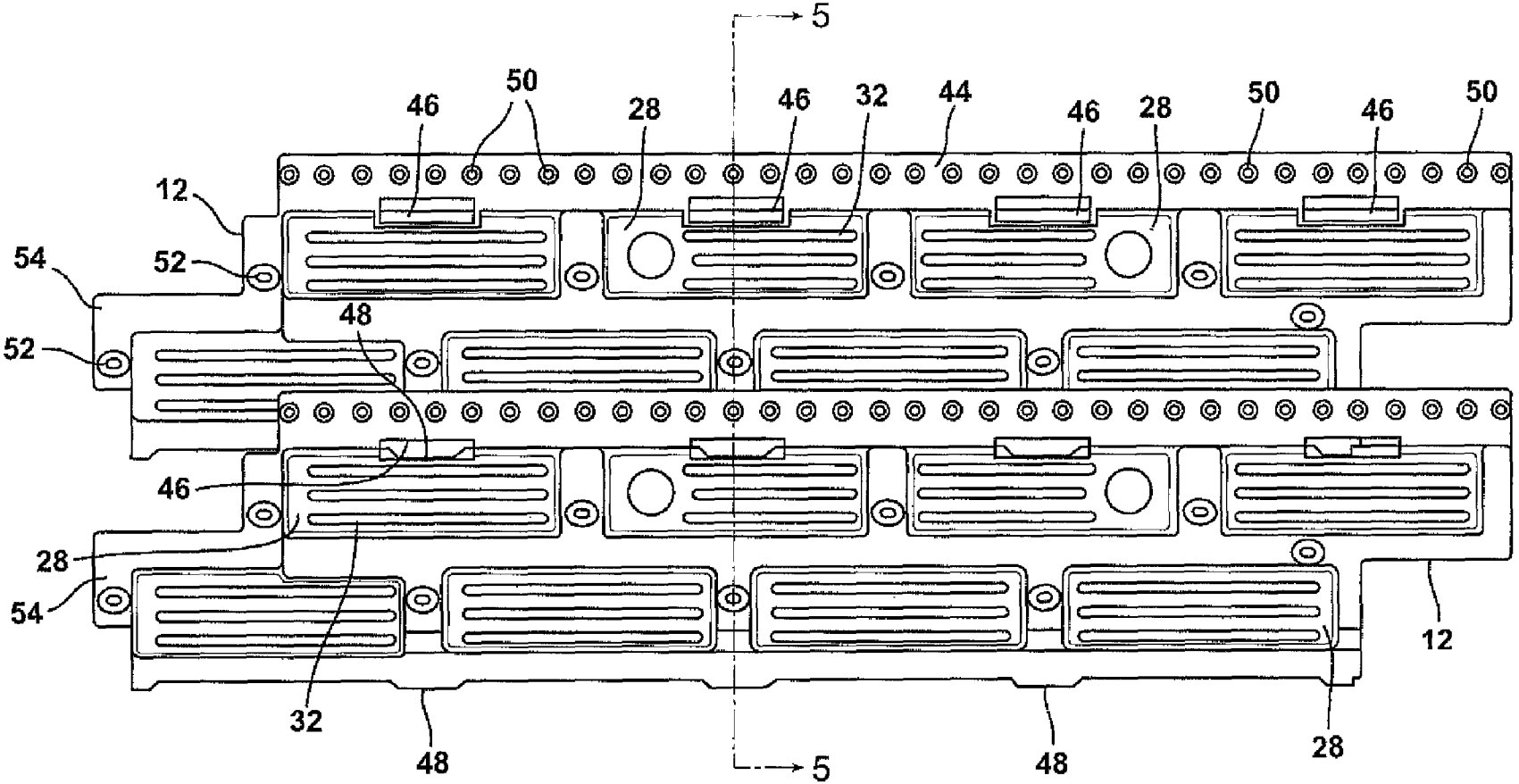
FIG. 4 is a rear elevational view illustrating the alignment and connection of two of the backing panels as illustrated in FIG. 3.

As best illustrated in FIG. 4, the rear face 16 of the backing panel 12 preferably includes a series of concavities 28, and the front face 14 includes a series of corresponding, projecting pads 30 that nest within the design elements 24 of the facing panel 14. More specifically, during production of the cast veneer wall panel 10, some of the cast material enters the concavities 28 through the apertures 32 in the wall of the backing panel defining the concavities 28 and pads 30 (note set cast material 34 illustrated in FIG. 2 that keys the panels 12, 14 together). The cast material 34 wraps around the margins of the backing panel 12 surrounding the apertures 32. When this cast material sets, the facing panel 14 and backing panel 12 are securely fastened together.

Figure 3:
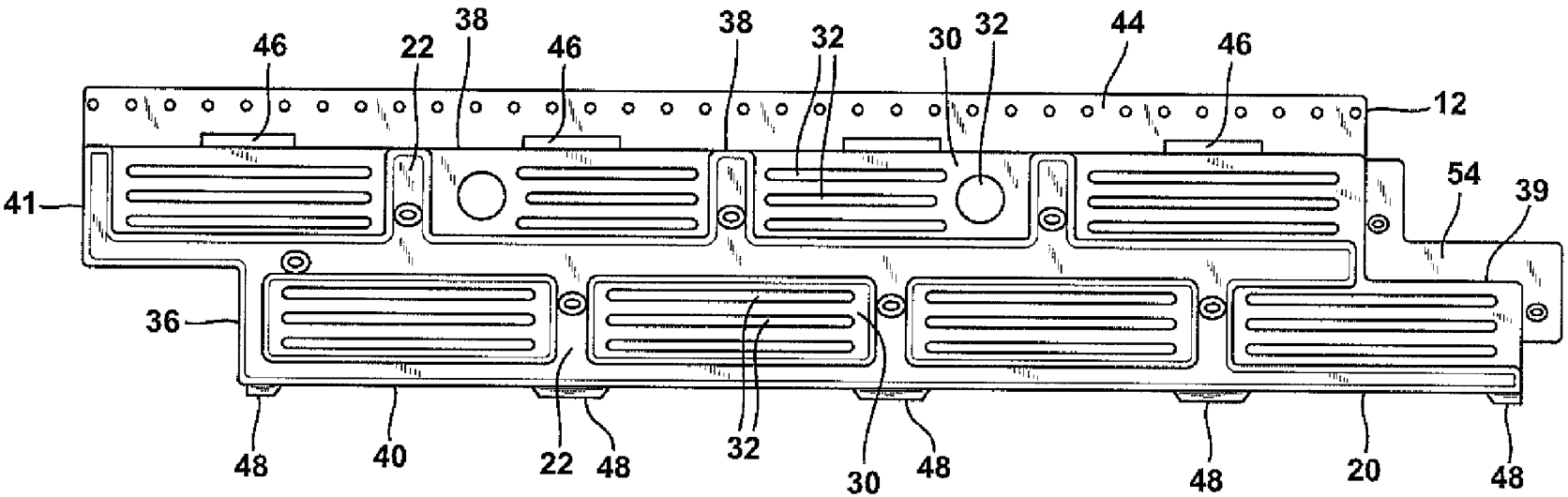
FIG. 3 is a front elevational view of the backing panel used in the cast veneer wall panel illustrated in FIG. 1.

As best illustrated in FIG. 3, a continuous abutment 36 is formed by the boundary wall 20 and a wall portion of several of the concavities 28/pads 30. As illustrated, the abutment 36 extends completely around the perimeter of the casting field 22. The abutment 36 effectively maintains the casting material used to make the facing panel 14 inboard of the abutment on the casting field 22. At the same time, the abutment 36 provides a continuous abutment face 37 free and clear of any cast material. Such an abutment face 37 allow a better fit and finish in a manner described in greater detail below. In an alternative embodiment, the abutment 26 is provided in a substantially continuous manner. In yet another embodiment, the abutment 36 may be provided in a discontinuous manner to provide a discrete mating surface at each interface to an adjacent panel.

Figure 5:
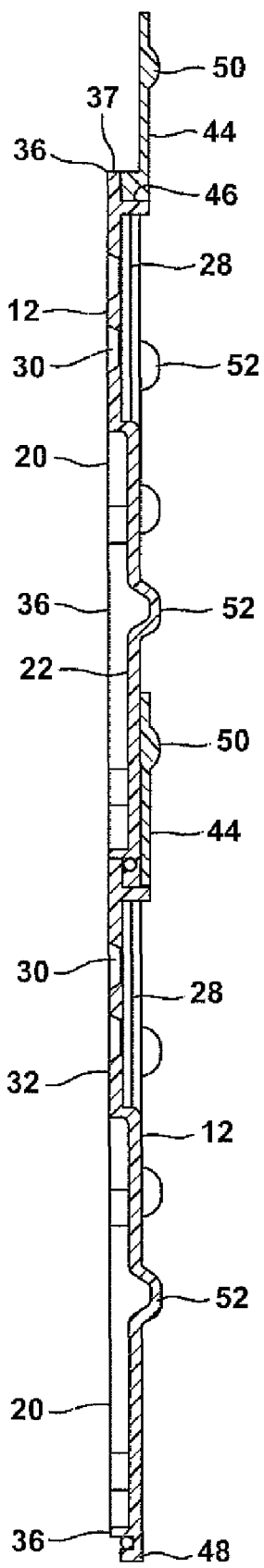
FIG. 5 is a cross sectional view of the backing panels illustrated in FIG. 4.
Figure 6:
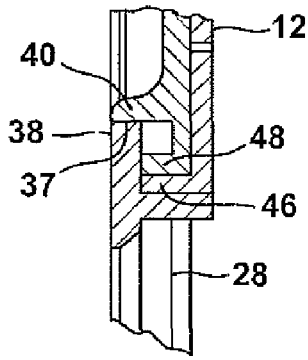
FIG. 6 is a detailed cross sectional view illustrating the connection of the locating tab on one cast veneer wall panel and the locating slot on another cast veneer wall panel.

As best illustrated in FIGS. 3-5, the backing panel 12 further includes a mounting flange 44 that extends beyond a first portion 38 of the continuous abutment 36. A series of locating slots 46 are provided in the first portion 38 of the abutment 36. In the illustrated embodiments each of the locating slots 46 extends into the mounting flange 44 and also communicates with the adjacent concavities 28 through the walls of the pads 30.

The backing panel 12 further includes a series of locating tabs 48 that project from a second portion 40 of the continuous abutment 36. The second portion 40 is opposite the first portion 38 of the abutment 36. When the cast veneer panel 10 is properly installed on the framework of a building (see FIG. 2), the first portion 38 is provided at the top of the cast veneer panel 10 while the second portion 40 is provided at the bottom or base. Thus, adjacent panels may be retained by an adjacent panel in an in/out relationship relative to the vertical wall, and/or in a side-to-side (lateral) manner with respect to an adjacent panel.

As best illustrated in FIG. 4, the rear face 16 of the backing panel 12 is provided with a series of spaced dimples 50. The dimples 50 project outwardly from the rear face 16 in order to provide an appropriate air gap G between the panel 10 and the sheeting S of the building framework in order to allow for moisture dissipation (see FIG. 2). In the illustrated embodiment, a row of dimples 50 are provided along the rear of the mounting flange 44. The dimples 50 have a depth of approximately 0.125 inches and provide a minimum flow area of about 65%. Additional dimples 52 are provided at spaced locations along the rear face 16 between the concavities 28. Obviously, the dimples 50, 52 may be cut down or ground down as necessary in order to compensate for any bowing or deviation in the sheeting S that might otherwise cause a wall panel 10 to seat improperly.

Reference is now made to FIGS. 2, and 4-6 illustrating the installation of one cast veneer wall panel 10 over another cast veneer wall panel 10' previously installed to the sheeting S of a building. The first cast veneer wall panel 10' is properly positioned on the sheeting S. A series of nails or other fasteners F are then driven through the mounting flange 44 into the sheeting S and any underlying wall studs (not shown) in order to secure the first cast veneer wall panel 10' in position. The installer places the second cast veneer wall panel 10 over the first cast veneer wall panel 10' by initially aligning the locating tabs 48 at the bottom of the wall panel 10 in the locating slots 46 at the top of the wall panel 10'. The top edge of the wall panel 10 is then pivoted toward the sheeting S and the locating tabs 48 on the wall panel 10 drop fully down into the locating slots 46 on the wall panel 10' until the wall panel 10 is fully seated with the second portion 40 of the abutment 36 of the top wall panel 10 resting on and abutting the first portion 38 of the abutment 36 of the lower wall panel 10' (see FIG. 6). The cooperating locating slots and tabs 46, 48 ensure that the two wall panels 10, 10' are properly oriented so that each row of design elements 24 is properly staggered. At the same time, the continuous abutment 36 ensures that the abutment face 37 around each backing panel 12 is presented for direct contact/abutment with the abutment face 37 of any adjacent panel. As a consequence, no cast material interferes with the manufactured fit of the wall panels 10, 10'. By avoiding any cast material-to-cast material contact between adjacent wall panels 10, 10', it is possible to maintain closer dimensional tolerances and thereby provide a better fit and finish.

Once the wall panel 10 is properly seated on the wall panel 10' with the locating tabs 48 fully received in the locating slots 46 and the ridges 20 of the two panels in abutting engagement (see FIG. 2), the installer uses fasteners F driven through the mounting flange 44 of the wall panel 10 in order to secure the new wall panel 10 in position. Significantly, it should be noted that the interlocking locating slots 46 and locating tabs 48 on the wall panels 10, 10' mean that fasteners only need be provided in the mounting flanges 44 at the top of each wall panel in order to secure a wall panel in position. No fasteners are required along the bottom. This simplifies the installation process and allows a wall panel 10 to be installed in a shorter period of time. While not illustrated, it should be appreciated that proper spacing between the design elements 24 of side-by-side wall panels 10 is maintained by the third and fourth portions 39 and 41 of the continuous abutment 36 and the second margin 54 as illustrated at the left side of wall panel 10 in FIG. 3. Following installation of all the wall panels 10, the mortar bed area 26 is grouted between the design elements 24 in order to provide the desired finished masonry appearance.

Figure 9:
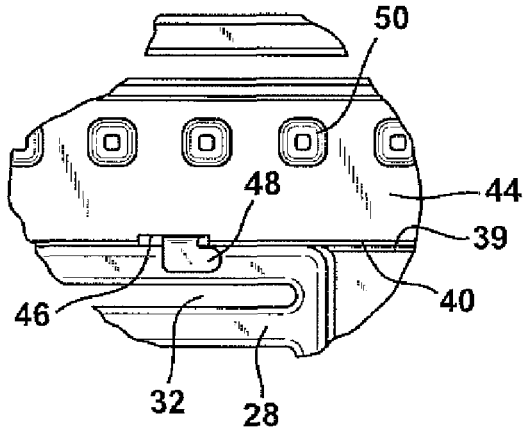
FIG. 9 is a detailed rear plan view showing the connection of a hook shaped locating tab on one backing panel received in a locating slot in another backing panel.
Figure 7:
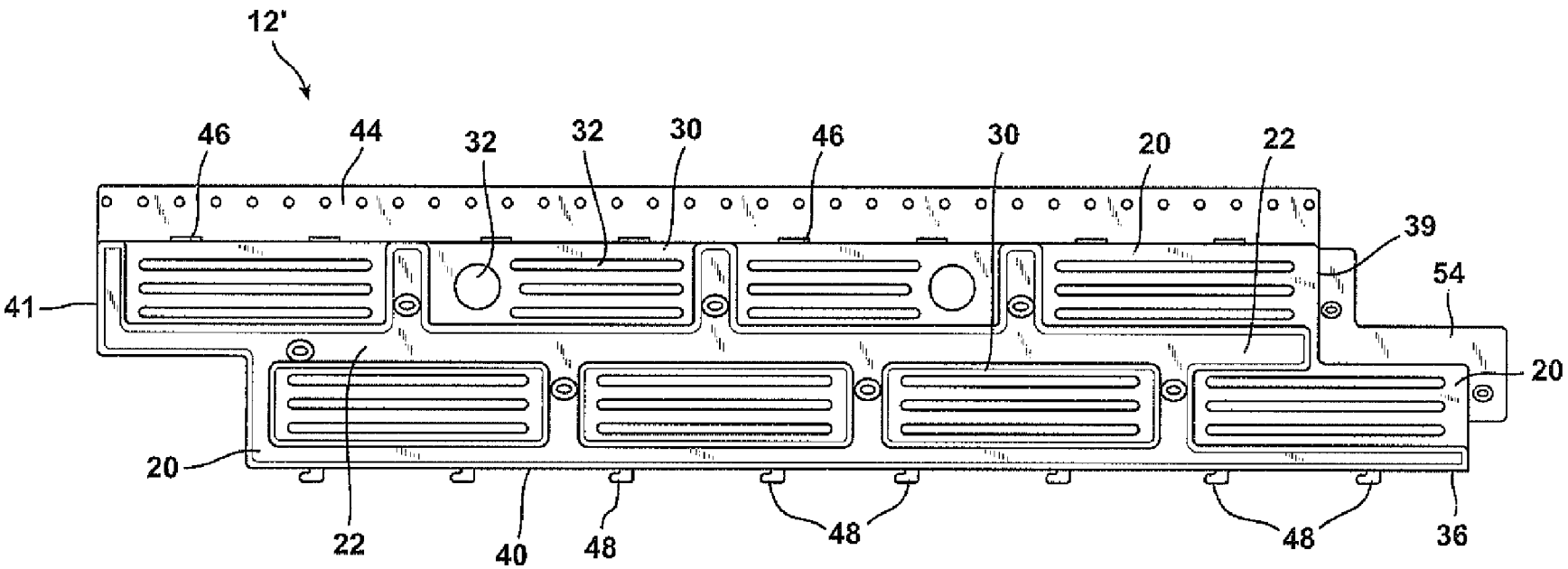
FIG. 7 is a perspective view of an alternative embodiment of a backing panel of the present invention.
Figure 8:
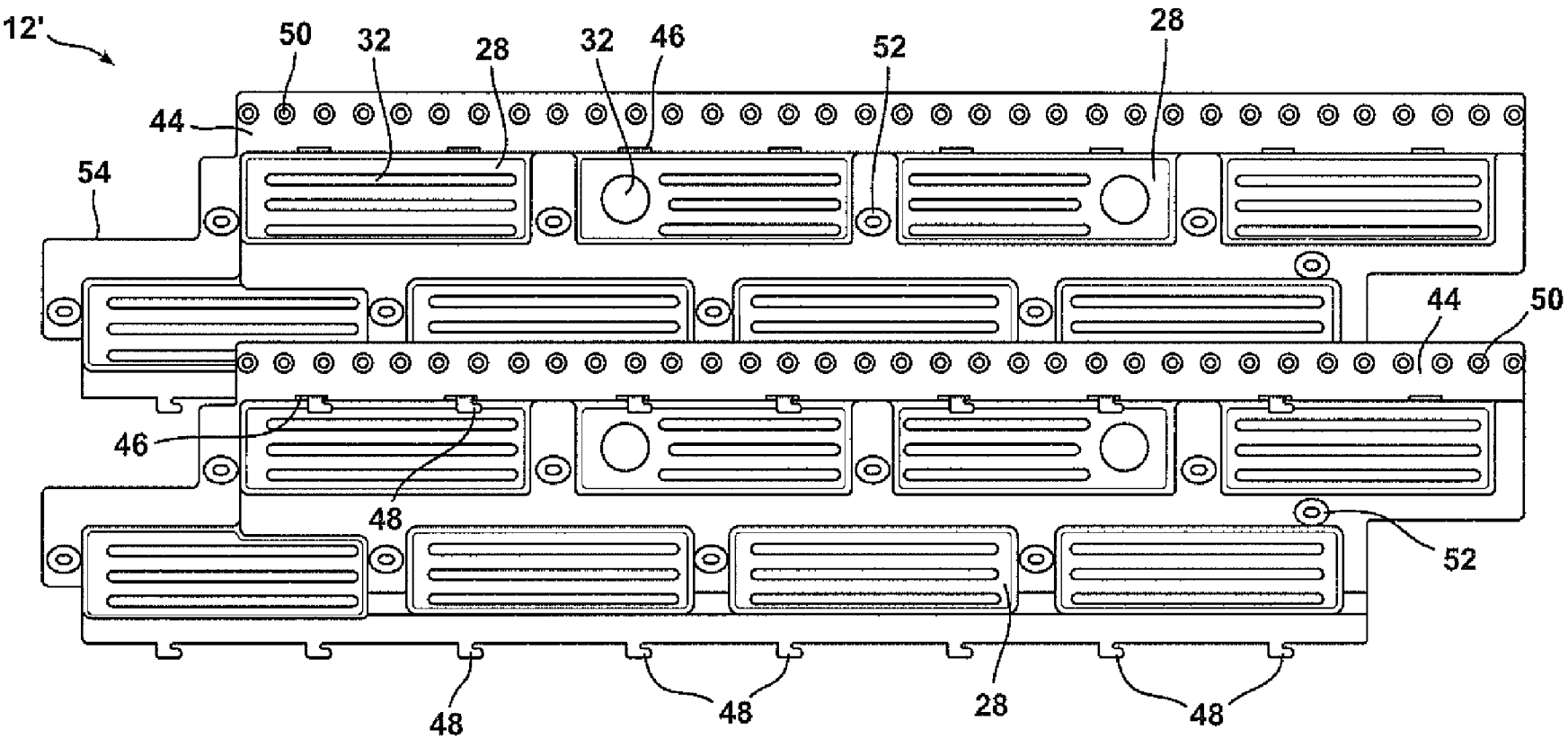
FIG. 8 is a rear plan view illustrating the connection of two backing panels of the type illustrated in FIG. 7.

Reference is now made to FIGS. 7-9 illustrating an alternative embodiment of a backing panel 12' of the present invention. The backing panel 12' illustrated in FIGS. 7-9 is identical to the backing panel 12 illustrated in FIGS. 1-6 except in one respect. Specifically, the locating tabs 48' are shaped in the form of hooks. The other structural features of the backing panel 12', corresponding with the backing panel 12, are identified with the same reference numerals.

During the installation of a wall panel 10, including the backing panel 12, over the top of another such panel, the locating tabs or hooks 48' are inserted in the cooperating locating slots 46 of a previously mounted wall panel 10'. Once the locating hooks 48' are fully inserted in the locating slots 46 the new wall panel 10 is shifted laterally in the direction of arrow A (see FIG. 9) so as to engage the hook with the abutment 36 of the underlying panel 10' and thereby securely interlock the two wall panels together.

In summary, numerous benefits result from employing the concepts of the present invention. A quick and efficient method of installing cast veneer wall panels is created. The method includes the steps of (a) fastening a first cast veneer wall panel to a support structure, (b) aligning cooperating tabs and slots provided on the first cast veneer wall panel and a second cast veneer wall panel, (c) engaging the tabs in the slots and (d) fastening the second wall panel to the support structure. Specifically, the method effectively reduces the number of fasteners required to secure the cast veneer wall panels to a support structure such as a building and conveniently aligns the panels for installation. These benefits are accomplished by providing the wall panels with cooperating locating tabs and slots that are engaged during wall panel installation.

Figure 10:
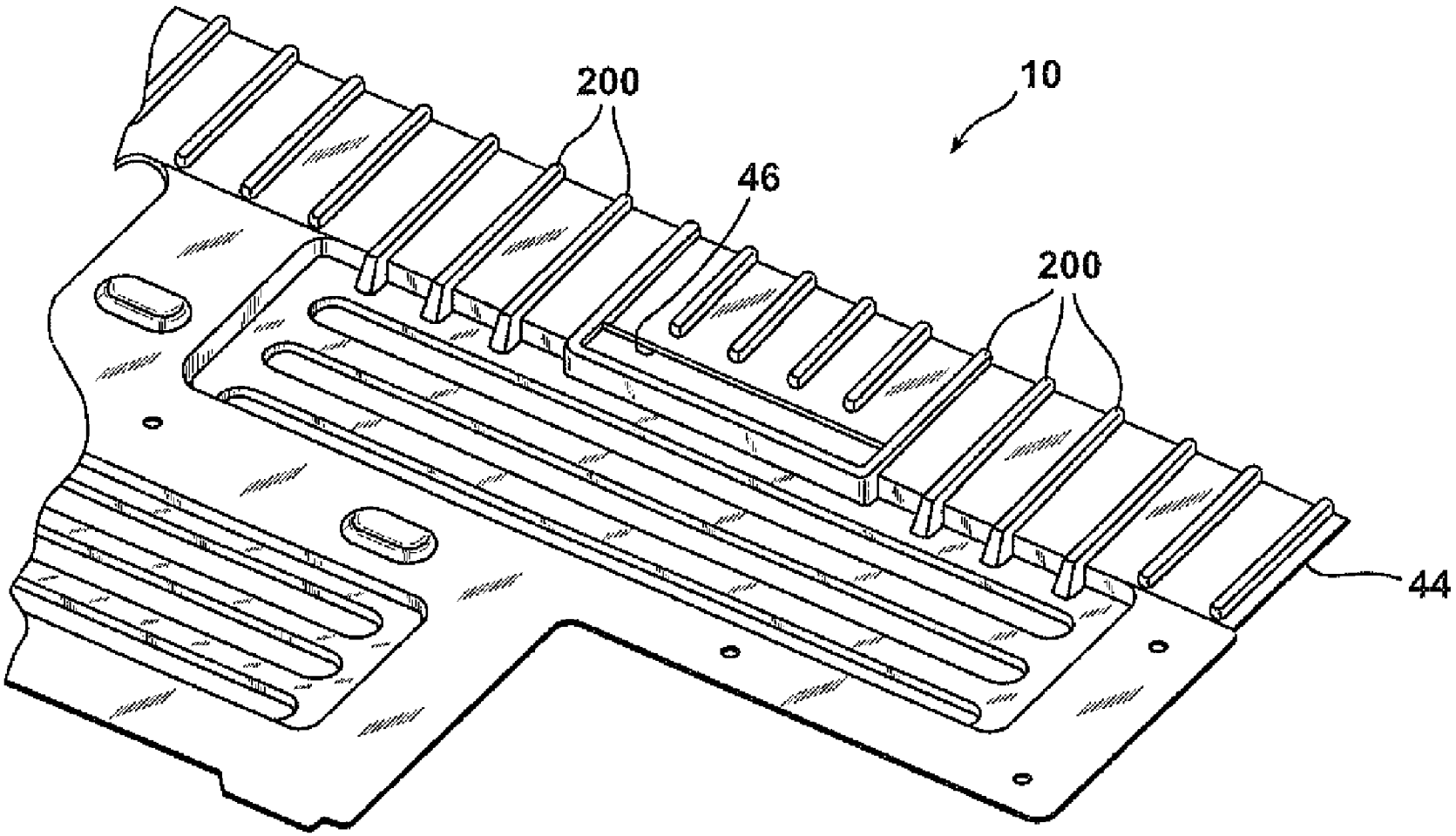
FIG. 10 is a rear perspective view of still another embodiment of the present invention.

The foregoing description of the preferred embodiments of the present invention have been presented for purposes of illustration and description. It is not intended to be exhaustive or to limit the invention to the precise form disclosed. Obvious modifications or variations are possible in light of the above teachings. For example, FIG. 10 illustrates a backing panel 12 including a series of spaced ribs 200 on the rear face of the mounting flange 44. The ribs 200 are provided in place of the spaced dimples 50. Typically, the ribs 200 are between about 0.05" and about 0.75" tall, between about 0.03" and about 0.5" wide and are spaced on centers of between about 0.25" and about 2.0". In one possible embodiment the ribs are 0.1" wide, 0.125" tall and are spaced on 0.58" centers. Like the dimples 50, the ribs 200 function to maintain an air gap between the panel 10 and the sheeting of the building framework for drainage and ventilation. The ribs 200 also function to strengthen the mounting flange 44 so that it will better hold a nail. Still further, cooperating locating tabs and slots could be provided at the opposite ends/sides of the panels 12 if desired. The optional structures could be similar to the locating tabs 48 and slots 46 provided along the top and bottom of the wall panel 12 (e.g. a tab at the right end of the panel shown in FIG. 8) to provide further interlock of adjacent panels.

The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims in their fair and broad interpretation in any way.

What is claimed:

1. A cast veneer wall panel, comprising:

a backing panel including a first mounting flange, a rear face and a front face, said front face including a casting field encircled by a boundary wall forming a continuous abutment extending around a perimeter of said casting field, and said first mounting flange extending beyond a first portion of said backing panel, said first portion positioned adjacent said continuous abutment;

a facing panel formed from a cast material received and held within said casting field, said facing panel including multiple design elements and a mortar bed area between said multiple design elements, said facing panel being received inside said continuous abutment.

2. The wall panel of claim 1, further including at least one locating slot provided in said first portion.

3. The wall panel of claim 2, wherein said at least one locating slot also extends into said first mounting flange.

4. The wall panel of claim 3, further including at least one locating tab projecting from a second portion of said backing panel, said second portion positioned adjacent said continuous abutment.

5. The wall panel of claim 4, wherein said first portion and said second portion are opposite one another.

6. The wall panel of claim 5, wherein said rear face of said backing panel includes a concavity and said concavity nests in said at least one design element.

7. The wall panel of claim 6, wherein said at least one locating slot extends into said concavity.

8. The wall panel of claim 7, wherein said backing panel includes apertures in said concavity and casting material forming said facing panel extends through said apertures into said concavity to key said backing panel and said facing panel together.

9. The wall panel of claim 8, wherein said rear face includes a series of dimples or ribs projecting outwardly from said rear face.

10. The wall panel of claim 9, wherein a row of said dimples or ribs are provided along said mounting flange.

11. The wall panel of claim 10, wherein said row of said dimples or ribs provides a minimum flow area of about 65%.

12. The wall panel of claim 7, wherein said backing panel includes a second mounting flange extending beyond a third portion of said backing panel, said third portion positioned adjacent said continuous abutment and provided between said first portion and said second portion.

13. A cast veneer wall panel, comprising:

a backing panel including (a) a rear face, (b) a front facing including a casting field, (c) at least one locating slot extending through a first edge, and (d) at least one locating tab along a second edge;

a facing panel formed from a cast material received and held on said casting field, said facing panel including at least one design element; and a first mounting flange extending beyond said first edge.

14. The wall panel of claim 13, wherein said at least one locating slot extends into said first mounting flange.

15. The wall panel of claim 14, wherein said rear face of said backing panel includes a concavity and said concavity nests in said at least one design element.

16. The wall panel of claim 15, wherein said at least one locating slot extends into said concavity.

17. The wall panel of claim 16, wherein said backing panel includes apertures in said concavity and casting material forming said facing panel extends through said apertures into said concavity to key said backing panel and said facing panel together.

18. The wall panel of claim 17, wherein said backing panel includes a second mounting flange extending beyond a third edge provided between said first edge and said second edge.

19. The wall panel of claim 13, wherein said at least one locating tab forms a hook.

20. A backing panel for a cast veneer wall panel, comprising:

a body including a rear face and a front face, said rear face including a series of dimples projecting outwardly from said rear face, said front face including a casting field encircled by a boundary wall forming a continuous abutment extending around a perimeter of said casting field;

a first mounting flange extending beyond a first portion of said backing panel;

at least one locating slot extending through said first portion of said backing panel, said first portion being positioned adjacent said continuous abutment, said at least one locating slot further extending into said first mounting flange; and at least one locating tab projecting from a second portion of said backing panel, said second portion positioned adjacent said continuous abutment, said second portion being positioned substantially opposite said first portion.

21. The backing panel of claim 20, wherein a row of said dimples are provided along said mounting flange.

22. The backing panel of claim 21, wherein said row of said dimples provides a minimum flow area of about 65%.

23. The backing panel of claim 22, wherein said backing panel includes a second mounting flange extending beyond a third portion of said continuous abutment provided between said first portion and said second portion.

24. A backing panel for a cast veneer wall panel, comprising:

a body including:

(a) a rear face, said rear face including a concavity;

(b) a front face including a casting field for receiving cast material, said casting field substantially encircled by a boundary wall forming an abutment extending substantially around a perimeter of said casting field;

(c) at least one locating slot extending through a first edge, said at least one locating slot further communicating with said concavity; and (d) at least one locating tab along a second edge; and a first mounting flange extending beyond said first edge of said body, said at least one locating slot further extending into said first mounting flange.

* * * * *